US008636280B2

(12) United States Patent
Dörrie et al.

(10) Patent No.: US 8,636,280 B2
(45) Date of Patent: Jan. 28, 2014

(54) APPARATUS FOR STACKING FLAT ARTICLES ON-EDGE

(71) Applicant: W+D Direct Marketing Solutions GmbH, Loehne (DE)

(72) Inventors: Arne Dörrie, Löhne (DE); Gerald Benders, Löhne (DE); Horst Kostrzewa, Rödinghausen (DE); Wilfried Wieneke, Vlotho (DE)

(73) Assignee: W+D Direct Marketing Solutions GmbH, Loehne (DE)

( * ) Notice: Subject to any disclaimer, the term of this patent is extended or adjusted under 35 U.S.C. 154(b) by 0 days.

(21) Appl. No.: 13/675,101

(22) Filed: Nov. 13, 2012

(65) Prior Publication Data

US 2013/0136572 A1 May 30, 2013

Related U.S. Application Data

(63) Continuation of application No. PCT/EP2010/056484, filed on May 11, 2010.

(51) Int. Cl.
*B65H 29/42* (2006.01)

(52) U.S. Cl.
USPC ..... 271/179; 271/181; 271/198; 271/216

(58) Field of Classification Search
USPC ..... 271/177–179, 181, 184, 198, 213–216
See application file for complete search history.

(56) References Cited

U.S. PATENT DOCUMENTS

| | | | | |
|---|---|---|---|---|
| 2,843,378 | A | 7/1958 | Faeber | |
| 3,135,175 | A | 6/1964 | Dexter | |
| 3,842,719 | A * | 10/1974 | Fernandez-Rana et al. | 198/418.9 |
| 5,131,645 | A | 7/1992 | Ricciardi | |
| 5,186,452 | A | 2/1993 | Holbrook | |
| 6,951,333 | B2 | 10/2005 | Gösslinghoff et al. | |
| 2002/0017447 | A1 | 2/2002 | Emigh et al. | |

FOREIGN PATENT DOCUMENTS

| | | | |
|---|---|---|---|
| DE | 32 46 112 | A1 | 7/1983 |
| EP | 1 350 750 | A1 | 10/2003 |
| JP | 6113580 | U | 8/1986 |
| JP | 2000072311 | A | 3/2000 |

OTHER PUBLICATIONS

International Search Report of PCT/EP2010/056484.

* cited by examiner

*Primary Examiner* — Michael McCullough
(74) *Attorney, Agent, or Firm* — Laurence A. Greenberg; Werner H. Stemer; Ralph E. Locher

(57) ABSTRACT

An apparatus for stacking flat articles on-edge has a helical drive assembly with spaced-apart helical screws. The helical screws receive and hold the articles on-edge therebetween, and eject the articles towards a stack holding unit. The stack holding unit is configured to hold a stack of articles on-edge separately from the helical screws. The apparatus includes a conveyor that supports the lower edges of the articles during their transport to the stack holding unit. The stack holding unit has an article entry opening with a height that is smaller than a height of the articles to be stacked during operation, and the height of the article entry opening is preferably adjustable.

20 Claims, 6 Drawing Sheets

APPARATUS FOR STACKING FLAT ARTICLES ON-EDGE

CROSS-REFERENCE TO RELATED APPLICATION

This application is a continuation, under 35 U.S.C. §120, of copending international application No. PCT/EP2010/056484, filed May 11, 2010; the prior application is herewith incorporated by reference in their entirety.

BACKGROUND OF THE INVENTION

Field of the Invention

The invention relates to an apparatus and method for stacking flat articles on-edge.

United States patent application publication US 2002/0017447 A1 describes a large capacity apparatus and method for reorienting and assembling individual ones of flat articles, such as envelopes, into horizontal rows of articles which are vertically oriented, on edge, and stacked in facing relation. During operation, envelopes are delivered horizontally and seriatim, to an article rotation assembly. The rotation assembly reorients the envelopes into a vertical, on-edge orientation, and feeds them individually to a helical drive assembly. The drive assembly includes a pair counter-rotating helical screws, mounted on a pivotally suspended sub-frame. The screws transport the envelopes in spaced relation to an accumulating conveyor. The conveyor has movable brace plate, transversely positioned over a pair of conveyor belts. A roller on one end of the plate rests upon one of the belts. Successive envelopes are delivered to and stacked against the brace plate. As the pressure increases, the sub-frame pivots away from the plate until a predetermined limit is reached. A switch then actuates the conveyor belts for a brief period, to relieve the pressure. The conveyor drive cycle is thereafter periodically repeated, until a row is formed.

During operation of the known apparatus, successive articles are delivered to and stacked against a brace plate by the helical drive assembly. As compressive pressure increases in the developing envelope stack, a sub-frame supporting the helical drive assembly pivots rearwardly, away from the support plate, until a predetermined physical limit is reached. A proximity switch then actuates the electric motor to advance the conveyors, the brace plate, and the formed stack of envelopes forwardly. This action also allows the sub-frame to rotate forwardly, and temporarily relieves the pressure in the envelope stack. As the proximity switch no longer detects the presence of the sub-frame, the conveyor motor is deactivated.

SUMMARY OF THE INVENTION

It is accordingly an object of the invention to provide an improved apparatus for stacking flat articles on-edge and which overcomes the disadvantages of the heretofore-known devices and methods of this general type.

With the foregoing and other objects in view there is provided, in accordance with the invention, an apparatus for stacking flat articles on-edge, the apparatus comprising:

a stack holding unit configured to hold a stack of the articles on-edge, the stack holding unit having an article entry opening for receiving the articles, the article entry opening having a height, preferably an adjustable height, that is smaller than a height of the articles to be stacked during operation;

a helical drive assembly having spaced-apart helical screws disposed separately from the stack holding unit and configured to receive the articles therebetween in an on-edge orientation and to eject the articles towards the stack holding unit;

a conveyor configured to support lower edges of the articles during transport to the stack holding unit;

the helical screws and the conveyor being configured to cooperate to reposition each article from a first angular position with respect to a transport path to a different second angular position with respect to the transport path; and the helical drive assembly being configured to eject each article at a higher speed than an instantaneous conveying speed of the conveyor.

In accordance with an added feature of the invention, the conveyor and the stack holding unit are configured to cooperate to reposition at least a plurality of the articles from a second angular position to a different, third angular position. Preferably, the third angular position is substantially equal to the first angular position.

In accordance with an additional feature of the invention, there is provided an article feeder disposed to feed the articles to the helical screws during operation, the helical screws and the article feeder being configured to operate in synchronicity.

In accordance with another feature of the invention, the conveyor is driven at a constant speed during operation.

In accordance with a further feature of the invention, the conveyor is a first conveyor and the stack holding unit includes a second conveyor configured to receive the articles on-edge from the first conveyor, and to support an accumulating stack of the articles on-edge. In a preferred embodiment, the stack holding unit includes a support section, the article entry opening being defined between an upper side of the second conveyor and a lower side of the support section.

There is also provided, in a further embodiment, a control unit for controlling a speed of the second conveyor in dependence of a position of at least one article. In one embodiment, the stack holding unit includes a sensor for detecting the presence of an article. The sensor may be advantageously placed to detect a presence of an upper edge of an article at a lower side of the article entry opening.

In accordance with yet an added feature of the invention, the assembly includes a sensor for detecting a presence of an article and a control unit for controlling a speed of the second conveyor in dependence of a measuring result of the sensor.

In accordance with yet a further feature of the invention, there is provided a loose article positioning member configured for supporting a first article during transport to the stack holding unit. The article positioning member may be supported on the conveyor and conveyed by the conveyor towards a stack holding area of the stack holding unit. In one embodiment, the article positioning member is configured to be transferred from the first conveyor to the second conveyor, and for supporting a first article in the stack holding unit.

Advantageously, the apparatus comprises a helical drive assembly having spaced-apart helical screws configured to receive the articles on-edge there-between, and to eject the articles towards a stack holding unit. The stack holding unit is configured to hold a stack of articles on-edge separately from the helical screws. The apparatus includes a first conveyor configured to support lower edges of the articles during transport to the stack holding unit.

During operation, the articles can be received on-edge between the helical screws of the helical drive assembly. The articles are then ejected towards the spaced-apart stack holding unit, the articles being supported on lower edges during their transport to the stack holding unit. As a result, the operation of the stack holding unit can be substantially independent of the operation of the helical drive assembly, providing a more efficient and reliable way of handling the articles. Also, the stack is held remote from the helical screws by the apparatus. Moreover, the application of a movable (pivoting) helical drive assembly can be prevented, leading to a much simpler, more robust and more accurate configuration.

In particular, during operation, the helical drive assembly does not directly act on a stack that is being formed. Also, the remote assembly does not press on the stack (nor does the stack press on the helical drive assembly). Thus, the drive assembly can function with relatively low friction, which is economical, and reduces maintenance cost. Moreover, the drive assembly does not act on a last article of a formed stack of articles, which significantly reduces wear on that article. Also, the stack can be held without requiring high compressive forces acting thereon.

With the above and other objects in view there is also provided, in accordance with the invention, a system for processing flat articles, the system comprising:

an apparatus as outlined above;

a feeding unit for feeding flat articles on-edge to the spaced-apart helical screws of the apparatus, the feeding unit including an article rotation assembly having flat endless belts arranged to convey articles therebetween, and to turn the articles during the conveying;

the feeding unit having a downstream belt section disposed to reach to a position opposite the helical drive assembly, for supporting a back side of an article during transfer into the helical drive assembly.

In accordance with a concomitant feature of the invention, the feeding unit includes a control unit configured to slow down the belt section that reaches to the position opposite the helical drive assembly, from a first speed to a second speed, during transfer of an article, for decelerating the article.

With the above and other objects in view there is further provided, in accordance with the invention, a method of stacking flat articles in an on-edge orientation. The method utilizes the apparatus as described and the method comprises:

receiving the articles on-edge between the helical screws of the apparatus;

ejecting the articles from the helical screws towards the spaced-apart stack holding unit; and supporting the articles on lower edges thereof during transport to the stack holding unit.

Other features which are considered as characteristic for the invention are set forth in the appended claims.

Although the invention is illustrated and described herein as embodied in an apparatus for stacking flat articles on-edge, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
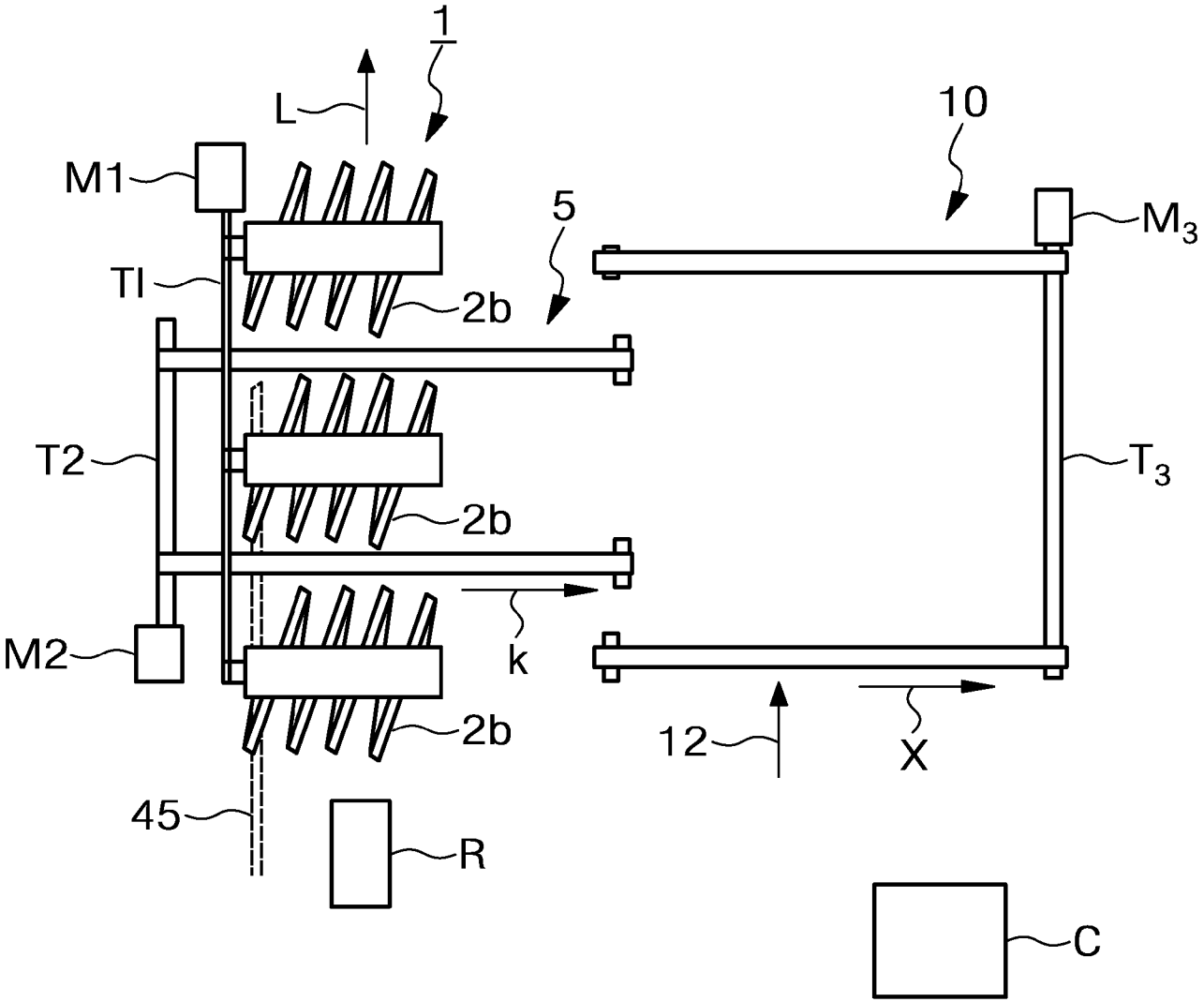
FIG. 1 schematically a plan view of a non-limiting embodiment of an apparatus according to the invention.

Reference will now be made to the figures of the drawing in which similar or functionally corresponding features are denoted with similar or corresponding reference numerals and symbols throughout this specification.

FIGS. 1-6 schematically show an apparatus for stacking flat articles E on-edge (i.e. with lower article edges arranged onto a stack support surface, i.e. opposite main external surfaces of the stacked articles E extending substantially upwardly from the lower edges). The apparatus can be part of a system that further comprising a feeder unit for feeding articles on-edge to stacking apparatus. The articles can be envelopes E, for example envelopes E holding inserts (for example mail, paper sheets, products and/or other inserts).

The stacking apparatus comprises a helical drive assembly 1 having spaced-apart helical screws 2 configured to receive the articles Eon-edge there-between, and to eject the articles E (in an ejection direction K) towards a stack holding unit 10 (also called a "stack accumulating unit", or "article accumulator").

The operation of such a helical drive assembly 1 is described in the above-mentioned US 2002/0017447 A1 (hereinafter "US '447"), which is incorporated in the present application by reference in its entirety. The helical drive assembly 1 of the present example differs from the configuration disclosed in US '447 in that the assembly includes a first (lower) row of helical screws 2*a* and a second (upper) row of helical screws 2*b*, the first row being located at a level below the second row. For example the first row 2*a* can include two or three screws, or more. Similarly, the second row 2*b* can include two or three screws, or more. Alternatively, one or each of the rows 2*a*, 2*b* can include just one screw 2. Also, the present example differs from the configuration disclosed in US '447 in that the helical drive assembly has a fixed position with respect to stack holding unit 10, i.e., it is does not pivot during operation. To that aim, the helical drive assembly 2 can be mounted to a suitable stationary frame or a stationary support system of the apparatus (not shown in the present schematic drawings), as will be appreciated by those of skill in the pertinent art.

In the example, helical screws 2*a* of the lower row are of opposite orientation (i.e., oppositely handed) or thread direction with respect to the screws 2*b* of the second row. A first drive system, for example including a first motor M1 and a respective first transmission T1 (for example including one or more belts, pulleys, chains, transmission wheels, and/or other drive transmission means), is provided for driving the screws 2. The drive configuration is such that lower screws 2*a* are rotatably driven in opposite direction with respect to the upper screws 2*b*.

The apparatus is provided with a control unit C (schematically depicted) for controlling various components of the apparatus, for example to control operation of the helical screw assembly. The control unit C can be configured in various ways, as will be appreciated by the skilled person. For example, the unit C can include one or more controllers, one or more computers, software, hardware, communication means (for example one or more wired and/or wireless communication devices), one or more power supplies, and/or other means to control operation of respective apparatus components. For example, the control unit C can be configured to control the drive M1 of the screw assembly 1, for (instantaneously) setting a desired article ejection speed. Also, the control unit C can be configured to synchronize an article feeding process (of transporting the articles E to the screws) with the operation of the helical screw assembly, particularly such that the screws 2 are always in a rotational position to receive an article between the screws 2 from an upstream feeder unit during that unit feeding an article into the space between the screws 2 (i.e. without the screws preventing blocking entry of the article).

Figure 6:
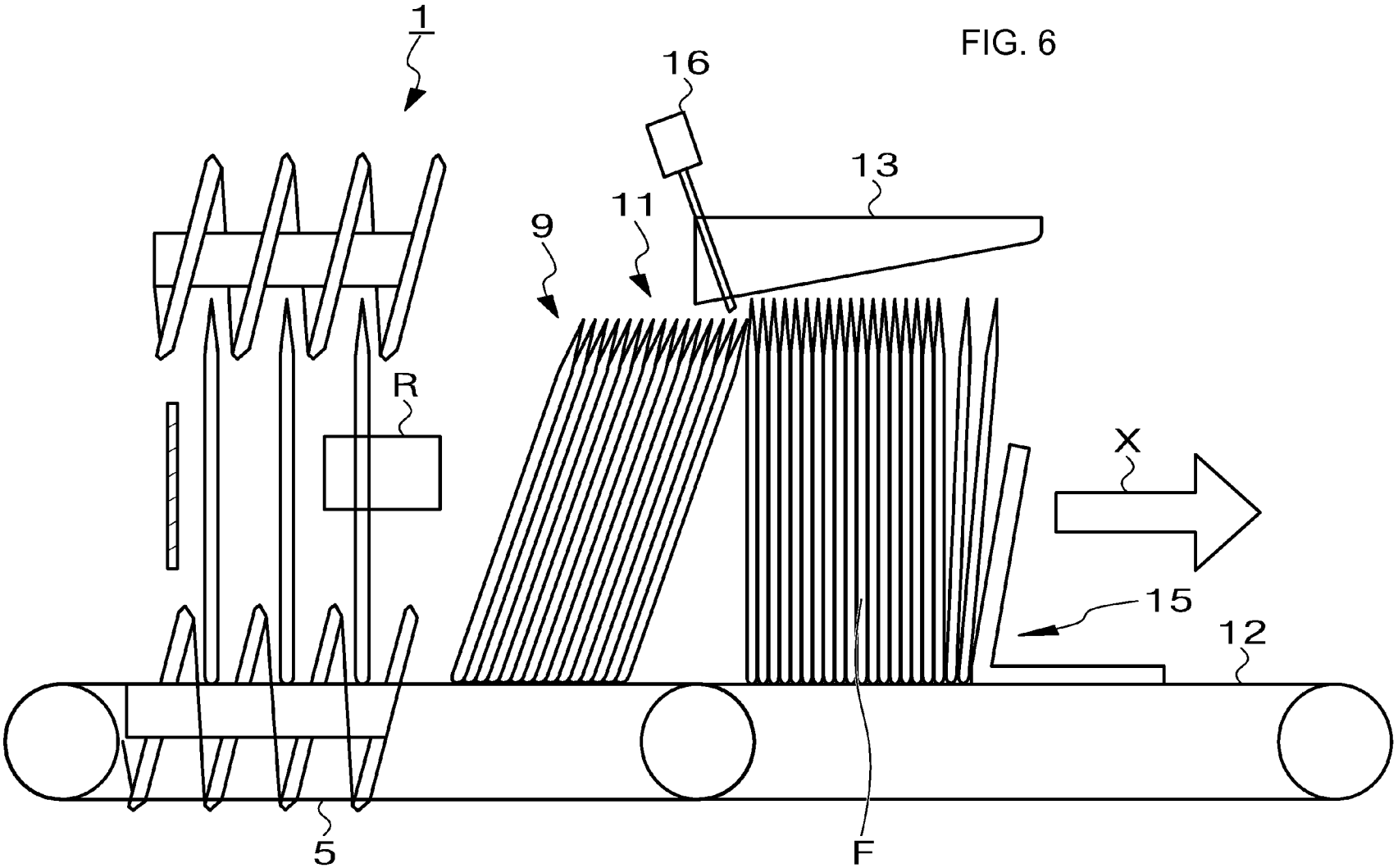
FIG. 6 a similar side view as FIG. 5, during a subsequent step, during stack formation in the holding unit.

The stack holding unit 10 is configured to hold a stack F of articles E on-edge, separate from the helical screws 2 (as in FIG. 6, see below). The apparatus includes a first conveyor 5 configured to support lower edges of the articles E during transport to the stack holding unit 10. In the present example, the first conveyor 5 includes a number (in this case two) conveyor endless belts, being driven by a respective second motor M2 (coupled to the belts via a suitable second transmission T2). A conveying direction of an upper part of the first conveyor 5 (the upper part supporting the envelopes E at their lower edges during transport) is away from the screw assembly (in line with an article ejection direction K of the screws 2), and towards the stack holding unit 10. An upper surface of the first conveyor 5 can be positioned at or just below an article support level that is provided by the lower screws 2*a* to provide smooth transfer of articles from the screws to that conveyor 5 (as in FIG. 2).

The stack holding unit 10 is provided with a second conveyor 12, configured to hold the stack F of articles Eon-edge (i.e. each article in the stack being on-edge), separate from the helical screws 2 (as in FIG. 6, see below). The second conveyor 5 can support the lower edges of the articles E. As follows from FIGS. 1-2, the first conveyor 5 and second conveyor 12 are arranged such that the first conveyor 5 can transfer articles Eon-edge onto the second conveyor 12, to be transported further by the second conveyor 12.

In the present example, the second conveyor 12 includes a number (in this case two) endless conveyor belts, being driven by a respective second motor M3 (coupled to the belts via a suitable second transmission T3). In the example, article conveying directions provided by the first and second conveyor are in parallel. A conveying direction of an upper part of the second conveyor 12 (the upper part supporting the envelopes E at their lower edges during the formation of the stack) is away from the screw assembly, as is schematically indicated by an arrow X in the drawing. An upper surface of the second conveyor 12 can be positioned at or just below an article support level that is provided by the first conveyor 5 to provide smooth transfer of articles from the first 5 to the second conveyor 12 (as in FIG. 2).

Figure 3:
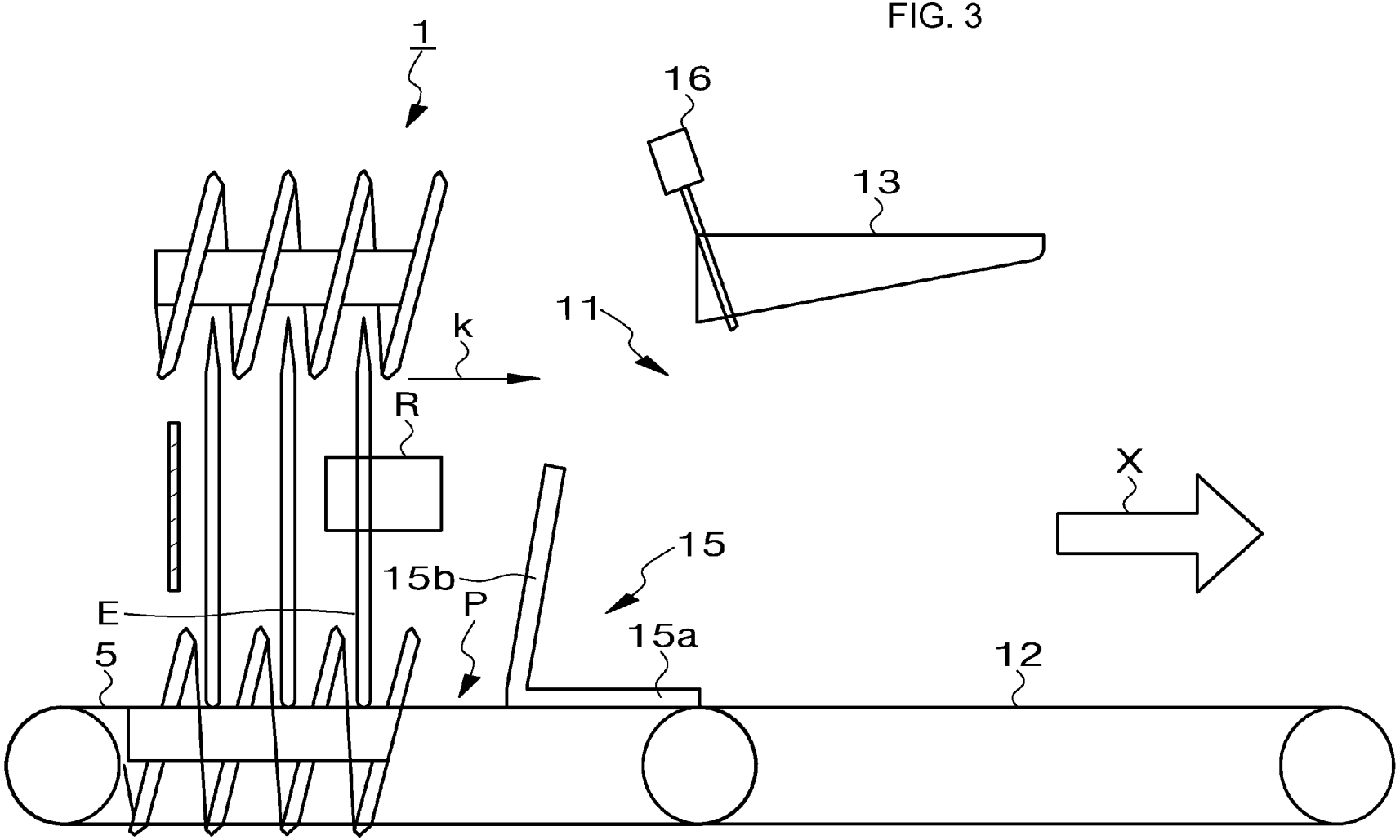
FIG. 3 a similar side view as FIG. 2, during a subsequent step, after having received three articles.
Figure 4:
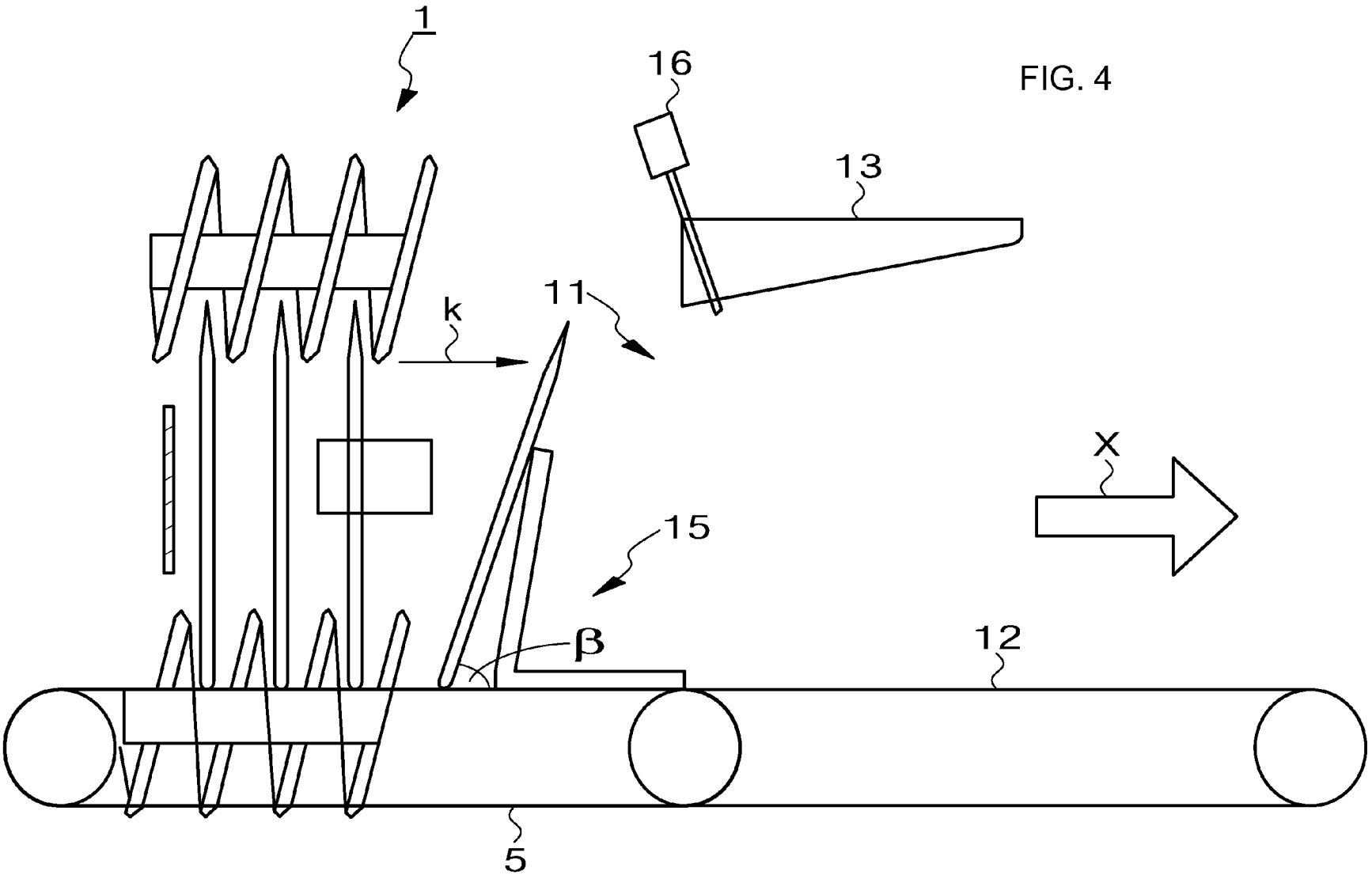
FIG. 4 a similar side view as FIG. 3, during a subsequent step, after having ejected the first article.

According to a further elaboration, the helical screws 2 and the first conveyor 5 are configured to cooperate to reposition each article from a first angular position with respect to a (in this example substantially horizontal) transport path P (shown in FIG. 2-3), to a different second angular position with respect to the transport path (shown in FIG. 4). In this case, the articles E include a first angle of (in this example) about 90 degrees with the transport path (i.e. they extend substantially normally with respect to a screw assembly ejection direction K) when they are in their first angular position. As follows from FIG. 4, when the articles E are present on the first conveyor 5, downstream with respect of the screw assembly 1, they include a second angle with the transport path that is smaller than said first angle, for example a second angle 6 in the range of about 45-80 degrees.

The afore-mentioned cooperation between screw assembly 1 and conveyor 5, adjusting the angle of the articles E when they are being supported on-edge, can be achieved in various ways. In a further embodiment, the screw assembly 1 is configured to eject each article E with a speed (in ejection direction K) that is higher than an (instantaneous) article conveying speed that is provided by the first conveyor. As a result, the articles E leaving the screw assembly 1 with a relatively high first speed will contact the first conveyor 5 on-edge, the first conveyor (having a lower speed than the first speed) decelerating the lower edges of the articles E (due to friction acting between the article E and the first conveyor 5), leading to rotation of each article E about its lower edge (to the second angular position/orientation).

Preferably, the apparatus includes a means for holding each article in its second angular position during the transport to the stack holding unit 10. For example, the first conveyor 5 can be provided with support elements, for example protrusions, to support an article E at a lateral side during its transport to the stack holding unit, to be held therein.

In the present example, advantageously, the apparatus comprises a loose article positioning member 15, for supporting a first article E (ejected from the helical screw assembly) with respect to the first conveyor 5, in a second angular position, as described. The present article positioning member 15 is configured for supporting the first article E at a front side during transport to the stack holding unit 10. The article positioning member 15 is provided with a base part 15*a*, configured to be supported onto the first conveyor 5 at the start of operation, and a support part 15*a* extending upwardly from the base part 15*a*, to support the article E at a position that is spaced-apart from the article's lower edge (see FIG. 4). For example, the article positioning member 15 can be relatively heavy, for example having a weight of 1 kg or more, to provide a stable support. Also, preferably, at least the base section 15*a* of the article positioning member 15 is relatively wide, so that it can be supported along an entire width of the first conveyor 15 (measured laterally with respect to the article transport direction). The loose article positioning member 15 is not attached to the first conveyor 5, i.e. it is a separate component of the apparatus.

Thus, the present article positioning member 15 is configured to be supported on the first conveyor 5, to be conveyed thereby towards a stack holding area of the stack holding unit 10 (see FIGS. 2-5). Moreover, the loose article positioning member 15 can be transferred from the first conveyor 5 to the second conveyor 12, and for supporting a first article E (at a front side) in the stack holding unit 10 (see FIG. 6).

In a further embodiment, the first conveyor 5 is controlled (by the control unit C) to be driven at a constant speed during operation. Similarly, in a further embodiment, the helical screw assembly 1 is controlled (by the control unit C) to be driven at a constant speed during operation.

Besides, in a further embodiment, a ratio between a speed of the helical screw assembly 1 and a speed of the first conveyor 5 can be constant during operation (wherein the article ejection speed provided by the screw assembly 1 is preferably higher than the speed of the first conveyor 5, as has been mentioned above).

Figure 5:
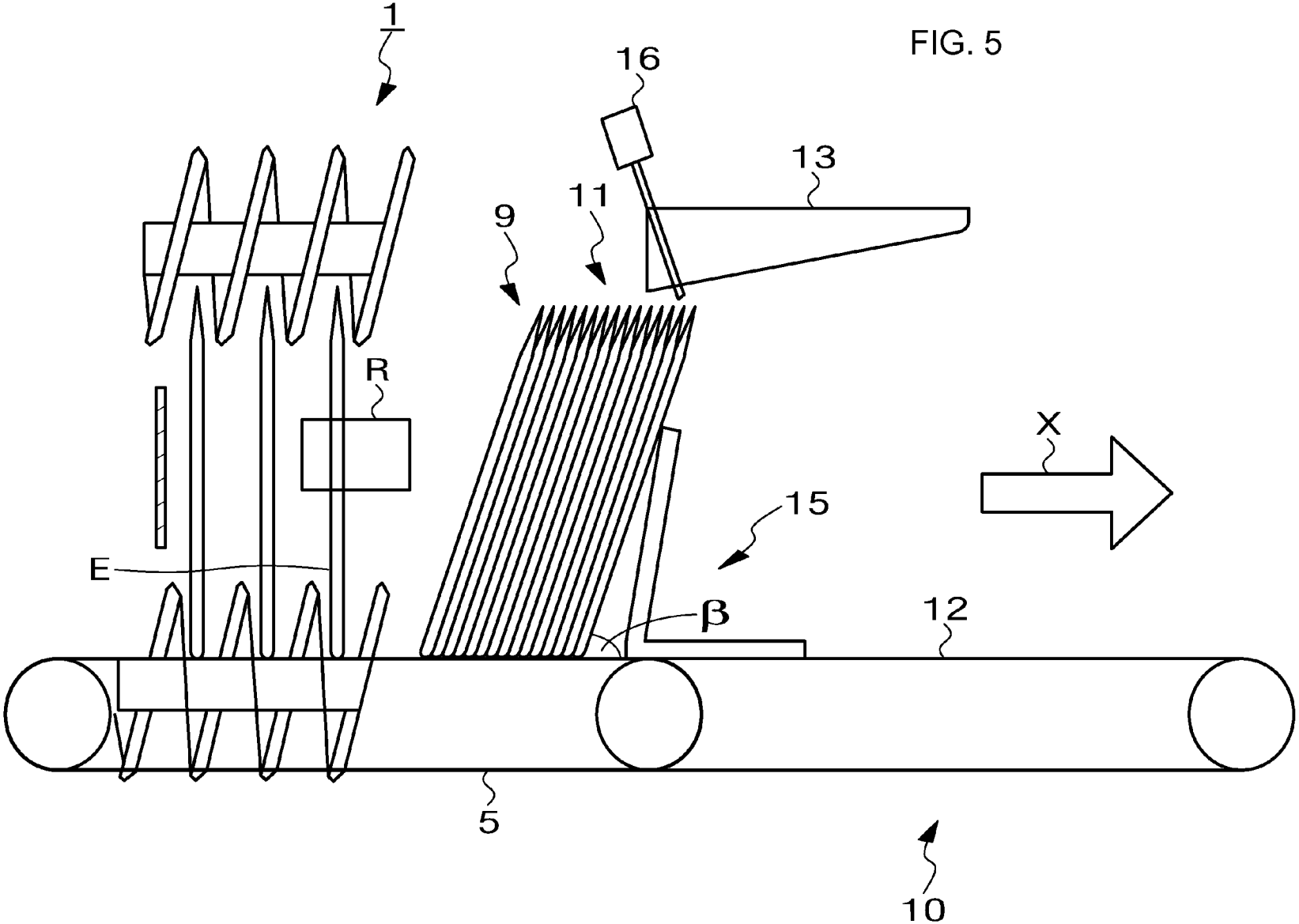
FIG. 5 a similar side view as FIG. 4, during a subsequent step, while articles enter the holding unit.

Moreover, as follows from FIGS. 5-6, in the present example, the first conveyor 5 and the stack holding unit 10 can be configured to cooperate to reposition at least a number of the articles E from the second angular position to a different third angular position. Particularly, the third angular position is about the same as the first angular position (see FIG. 6). In the example, the repositioning is achieved by the first conveyor 5, shifting each subsequent article E upwardly against a free end of a stack part that is already located in/on the stack holding unit 10.

Moreover, the present stack holding unit 10 is provided with an article entry opening 11 (a gate) for receiving the articles from the first conveyor 5. A height H1 of the entry opening 11 is smaller than a height H2 of the articles that are to be stacked during operation. However, the height H1 of the entry opening 11 is configured such that an article E that is in a respective second angular orientation can pass that opening 11. When an article E has been repositioned to (i.e. pivoted back) from the second angular position a respective third angular position, the article's upper edge is prevented to return towards the first conveyor 5 due to blocking at/near the entry opening 11 (as will be described below).

Preferably, the height H1 of the article entry opening 11 is adjustable, to accommodate for receiving articles of different height (such as different types of envelopes).

The present stack holding unit 10 includes a support section 13, defining an upper edge of the article entry opening 11 (the afore-mentioned article entry opening 11 therefore being provided between an upper side of the second conveyor 12 and a lower side of the support section 13). During operation, the articles E pass the opening 11, below the support section 13, thereby entering the holding area to be stacked onto a stack F to be formed. Also, during operation, the afore-mentioned article positioning member 15 will pass the opening 11, thereby entering the holding area to support a forward side of the stack F to be formed. The support section 13 can be arranged to engage a passed article E at an upper edge thereof, after the article E has been repositioned (on the second conveyor 10) to a respective third angular orientation, to prevent the article falling back towards the first conveyor 5. However, that is not essential, for example in case a forward side of an article E—in a respective third angular position—enclose an angle smaller than 90 degrees with the second conveyor 12.

The support section 13 can be configured in various ways, and is preferably adjustable to adjusting the entry opening's height 2. Alternatively or additionally, a position of the second conveyor 12 can be adjustable to alter that height H2.

As follows from the above, the second conveyor 12 of the stack holding unit 10 can receive the articles E on-edge from the first conveyor 5, and support these articles in an accumulating stack F, on-edge. Thus, the second conveyor 12 acts as an article accumulator. Also, the support section 13 of the stack holding unit 10 and the loose article positioning member 15 can cooperate with the second conveyor 12 to hold the stack F there-between (see FIG. 6), the support section 13 for example preventing a last stack section falling back to the first conveyor 5, and the article positioning member 15 serving to support a front side of the stack F.

Preferably, the second conveyor 12 is controlled (for example by the control unit C) intermittently, for example based on a sensor signal (see below) relating to the size of the stack part F that is formed thereon. As a result, preferably, a speed of the second conveyor 12 can be zero during certain operational periods, wherein the second conveyor 12 is only activated for a certain (relatively short) amount of time to provide additional stack supporting space for receiving a further batch (for example one or more) of articles E to be stacked.

Preferably, the stack holding unit 10 can be provided with a sensor 16 for detecting the presence of an article E. A respective sensor signal can be processed by the control unit C, for controlling operation of the stack holding unit 10 (particularly of the respective second conveyor 12). For example, the sensor 16 can be configured to detect the presence of an upper edge of an article at the lower side of the article entry opening 11, and in this case at the support section 13.

In the present drawings, the sensor 16 and support section 13 are shown as separate parts. Alternatively, the sensor 16 and support section 13 can be integrated with each other, the sensor 16 as such for example being configured to define an upper edge of the article entry opening, and optionally being configured to engage an article E at an upper edge to prevent the article falling back to the first conveyor 5.

The sensor 16 can be configured to detect if an upper edge of an article E (present on the second conveyor 12) contacts the support section 13, or when the upper edge comes close to the support section 13. To this aim, for example, the sensor 16 can be a pressure or force sensor, configured to detect a resulting pressure or force when the article E contacts the support section 13. Besides, in case the support section 13 is movably positioned with respect to the second conveyor 12, the sensor 16 can be configured to detect a certain movement of the respective support section 13, the movement being caused by an article touching that section 13. Also, the detecting of an article by the sensor 16 can be optical detection, ultrasonic detection, and/or a different detection manner.

The control unit C can control a speed of the second conveyor 12 in dependence of a position of at least one article E. In the example, the control unit C is configured for controlling the speed of the second conveyor 12 in dependence of a measuring result of the sensor 16.

During operation of the stacking apparatus, a method for stacking flat articles on-edge can be carried out, wherein the articles E are received on-edge between the helical screws 2. The articles can be fed by an upstream feeder unit, for example a unit as such is described in US2002/0017447, or a similar or different type of feeder unit. Preferably, the control unit C insures synchronization between the feeder unit and the screw assembly 1, to feed articles to suitable on-edge positions between the screws, to be subsequently ejected by the screws 2 in the ejection direction K.

The articles E are ejected one after the other by the screws 2 towards the spaced-apart stack holding unit 10. Each ejected article E is being supported on its lower edge by the first conveyor 5 during the transport towards the stack holding unit 10.

Also, as follows from the drawing, at the start of operation, the article positioning member 15 can be positioned on the first conveyor 5, near an exit area of the screw assembly, for supporting a first article E (at a respective front side) that is to be ejected by the assembly 1.

Preferably, in use, the first conveyor 5 can be driven continuously during operation (at least during the screw assembly transferring one or more articles there-between), for example at a speed having an above-mentioned speed ratio with respect to an article ejection speed that is achieved by the screw assembly 1. Preferably, the apparatus is provided with a speed adjuster (for example a knob or potentiometer, or a user interface of control unit C), to manually adjust the operating speed of the first conveyor 5.

For example, the first conveyor 5 can be driven at a lower speed than the article ejection speed, leading to pivoting of the articles on the first conveyor 5. Thus, each ejected article E can be automatically repositioned from the afore-mentioned first angular position with respect to a transport path P, to a second angular position with respect to the transport path.

Figure 2:
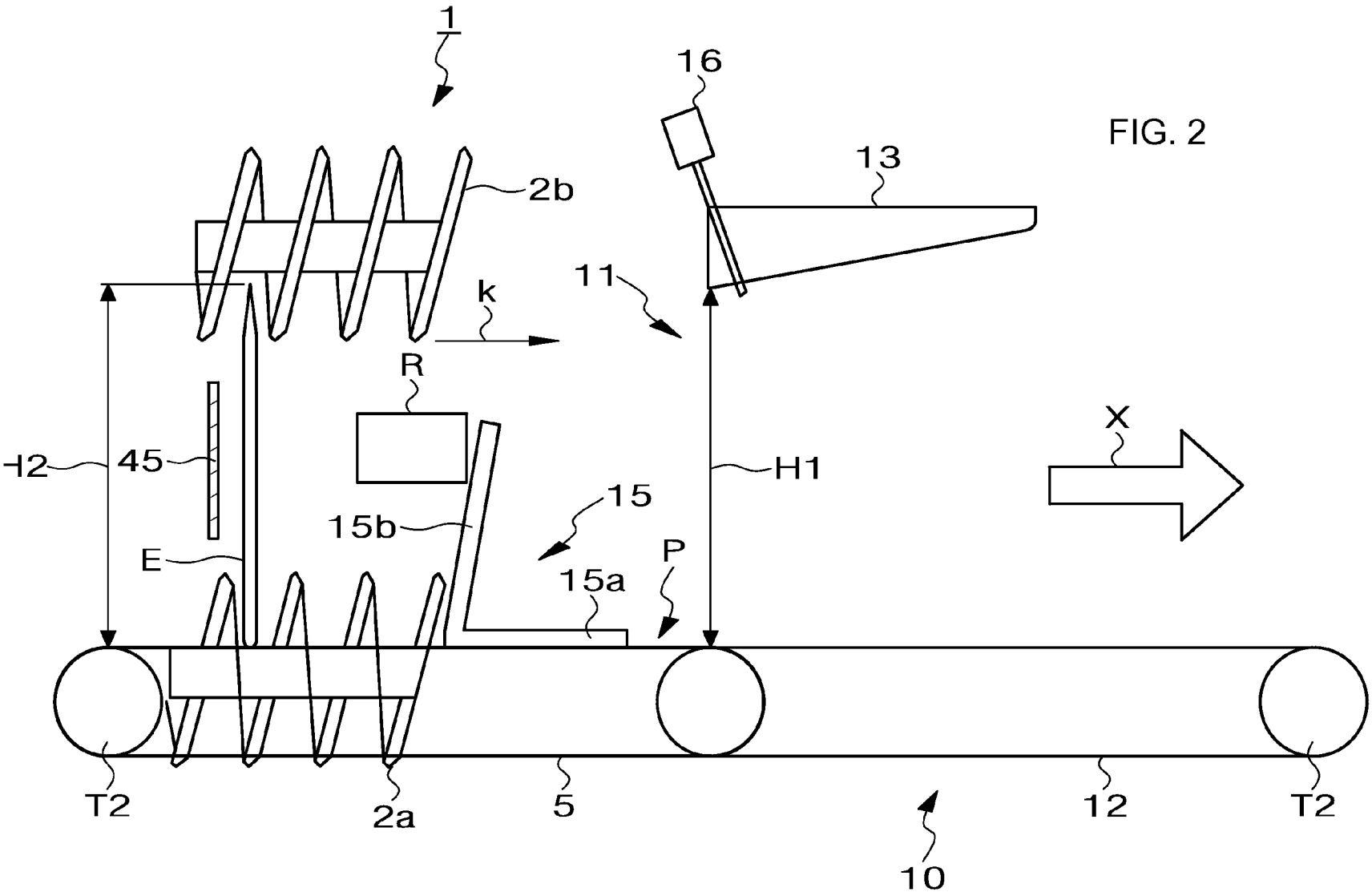
FIG. 2 schematically a side view of part of the embodiment shown in FIG. 1, while receiving a first article.

FIG. 2 shows the apparatus when a first article E has entered the screw assembly 1. FIG. 3 shows the embodiment, after three articles have been received in between the screws 2.

FIG. 4 shows a subsequent situation, in which a first article E has been ejected by the screws 2, the article E being pivoted to a respective second angular position, and being supported by both the first conveyor 5 and the positioning member 15. As follows from FIG. 5, subsequent articles E can be ejected by the screw assembly 1 towards the article positioning member 15, for example to form an initial stack G (on the first conveyor 5) upstream with respect to the stack holding unit 10, the initial stack G being spaced-apart from the screws 2. In the example, the articles of this initial stack G are all positioned in a respective second angular orientation, allowing their passages through the article entry opening 11.

It should be noted that the application of the positioning member 15 on the first conveyor 5 is optional, as the first conveyor 5 can also be driven at a certain speed to convey the ejected articles freely (without any other support) towards and into the stack holding unit, to be stacked therein.

In the depicted example, the first conveyor 5 operates to pass the positioning member 15 and on-edge articles E through the article entry opening 11 of the stack holding unit, and to transfer positioning member 15 and the articles E onto the second conveyor 12 to form the stack F. In another embodiment, a positioning member 15 can be located on the second conveyor 12, without having been transferred from the first conveyor.

A resulting stack F of articles is formed at the stack holding unit 10, against the (optionally transferred) positioning member 15, spaced-apart from the helical screws 2, and downstream with respect to the article entry opening 11.

Preferably, at least some of the articles E are reoriented again ("straightened-up") to afore-mentioned third angular positions, during passing and/or after having passed the article entry opening 11, particularly under guidance of a side surface of a formed stack part F. To this aim, the speed of the second conveyor 12 can be held lower than the speed of the first conveyor 5 (i.e. the speed of the stack F), such that the first conveyor 5 transports an article E with its lower edge to join a lower edge of the stack, a top edge of the article E shifting upwardly against the stack F.

It should be noted that the speed of the second conveyor 12 can also be about the same as the speed of the first conveyor 5, for example during an initial phase of stack formation. Such an initial phase can be the transferring of the positioning member 15 and an initial stack part G to the second conveyor 12 (positioning member 15 and an initial stack part G passing the entry opening 11). After that, the second conveyor 12 can be controlled to a lower speed, for receiving subsequent articles E from the first conveyor 5.

Also, during operation, the sensor 16 of the article holding unit 10 can trigger operation of the second conveyor 12 (for example under control of the control unit C), to periodically or iteratively shift the formed stack part F over a short distance away from the first conveyor 5, for example in case of detecting presence of a top edge of an article E (as is described above).

Therefore, compressive pressure (if any) acting on the stack F can be kept low. Thus, a large stack F of articles E can be accumulated on edge on the second conveyor 12, in a swift and efficient manner, without leading to large pressing forces acting between the articles and the screw assembly 1.

In a further elaboration of the invention, there can be provided a feeding unit, including an article rotation assembly having flat endless belts that are arranged to convey articles there-between, and to turn the articles during the conveying. Such a feeder unit as such is described in US2002/0017447, which is incorporated in the present application by reference in its entirety. According to the invention, preferably, the feeder unit can be adapted such that a downstream belt section 45 of the feeder unit (part of which is schematically shown in FIG. 1-2) reaches to a position opposite the helical drive assembly 1, for supporting a back side of an article during transfer into the helical drive assembly. The belt section 45 of the feeding unit can have a slight contact to the article E during the transfer, first to transport the article E complete into the screw assembly, and subsequently to avoid a rebound/flyback when the article E hits a stop.

Besides, optionally, the stacking apparatus can be provided with an article positioning device R (see FIGS. 1-3) configured to reposition a single article in a lateral direction with respect to the article transport path, before the article is being stacked. The article positioning device R can be configured in various ways as will be appreciated by the skilled person. In the present example, the article positioning device R is located near the helical screw assembly 1, and is configured to be controlled (for example by a control unit C of the apparatus) to laterally reposition a single article E that is present between the screws 2. For example, the article positioning device R can be a kicker, configured to kick an article that is present between the screws 2 in a lateral (for example horizontal) direction L (see FIG. 1) with respect to the transport path, sideways with respect to the screw assembly 1 (for example towards a gate for discharging articles E). To this aim, the kicker R can include an actuator for moving a kicking element onto a side edge of an article E, that is being transported in the screw assembly, thereby transferring momentum to the article E leading to the lateral shifting of the article over a relatively short range (for example over a distance of in the range of about 1 to 10 em, for example 1 to 5 em) in the lateral direction L. The kicking element can be retracted swiftly by the respective article, away from the kicked article, to allow passage of a subsequent article.

The lateral repositioning can be controlled, for example, based on an article detection system, for example a scanner, configured to detect one or more parameters of passing articles (such as one or more mailing parameters, for example a postal code, address, and/or other parameters). The detection system can be part of or associated with the control unit C of the apparatus, and can include one or more sensors (which can optionally be part of the positioning device R) to detect the parameter(s) of each passing article.

The repositioned (laterally shifted) article E can reach out of the stack F that is being formed (i.e. when the article has been stacked), for example to show an operator that a new article parameter (for example postal code) has started.

Also, in an embodiment, the positioning device R can be configured to remove an article E from the transport path, for example by applying a relatively large momentum that laterally ejects the article out of the screw assembly 1. Such ejection can be carried out, for example, in case the article detection system detects that the article E should not be stacked, based for example on one or more parameters of the article (for example a detected size, weight, content, one or more mailing parameters, and/or other parameters).

Although the illustrative embodiments of the present invention have been described in greater detail with reference to the accompanying drawings, it will be understood that the invention is not limited to those embodiments. Various changes or modifications may be effected by one skilled in the art without departing from the scope or the spirit of the invention as defined in the claims.

It is to be understood that in the present application, the term "comprising" does not exclude other elements or steps. Also, each of the terms "a" and "an" does not exclude a plurality. Also, a single processor or other unit may fulfill functions of several means recited in the claims. Any reference sign(s) in the claims shall not be construed as limiting the scope of the claims.

The invention claimed is:

1. A method of stacking flat articles on-edge, the method comprising the steps of:

providing a stack holding unit configured to hold a stack of the articles on-edge, the stack holding unit having an article entry opening for receiving the articles, the article entry opening having a height that is smaller than a height of the articles to be stacked during operation;

providing a helical drive assembly with spaced-apart helical screws disposed separately from the stack holding unit and configured to receive the articles therebetween;

providing a conveyor configured to support lower edges of the articles during transport to the stack holding unit and driving the conveyor at an instantaneous conveying speed;

receiving the articles between the helical screws in an on-edge orientation and repositioning each of the articles from a first angular position with respect to a transport path to a different second angular position with respect to the transport path; and ejecting each of the articles from the helical drive assembly towards the stack holding unit at a higher speed than the instantaneous conveying speed of the conveyor.

2. The method according to claim 1, which comprises adjusting a height of the article entry opening.

3. The method according to claim 1, which comprises causing the conveyor and the stack holding unit to cooperate to reposition at least a plurality of the articles from the second angular position to a different, third angular position.

4. The method according to claim 3, wherein the first angular position is substantially equal to the third angular position.

5. The method according to claim 1, which comprises feeding the articles to the helical screws and operating the helical screws and the article feeder in synchronicity.

6. The method according to claim 1, which comprises driving the conveyor at a constant speed.

7. The method according to claim 1, which comprises receiving the articles on-edge from a second conveyor and supporting an accumulating stack of the articles on-edge in a second stack holding unit.

8. The method according to claim 7, which comprises controlling a speed of the second conveyor with a control unit depending on a position of at least one article.

9. The method according to claim 7, which comprises detecting a presence of an article with a sensor and controlling a speed of the second conveyor with a control unit in dependence on a measuring result of the sensor.

10. The method according to claim 7, wherein the stack holding unit has a support section and the article entry opening is defined between an upper side of the second conveyor and a lower side of the support section.

11. The method according to claim 1, which comprises detecting a presence of an article with a sensor.

12. The method according to claim 11, which comprises placing the sensor to detect a presence of an upper edge of an article at a lower side of the article entry opening.

13. The method according to claim 1, which comprises supporting a first article during transport to the stack holding unit with a loose article positioning member.

14. The method according to claim 13, which comprises supporting the article positioning member on the conveyor and conveying the article positioning member with the conveyor towards a stack holding area of the stack holding unit.

15. The method according to claim 13, wherein the conveyor is a first conveyor and the stack holding unit includes a second conveyor configured to receive the articles on-edge from the first conveyor, and the method further comprises transferring the article positioning member from the first conveyor to the second conveyor and supporting the first article in the stack holding unit with the article positioning member.

16. The method according to claim 1, which comprises:

receiving the articles on-edge between the helical screws;

ejecting the articles from the helical screws towards the spaced-apart stack holding unit; and supporting the articles on lower edges thereof during transport to the stack holding unit.

17. The method according to claim 1, which comprises forming a stack of articles at the stack holding unit, spaced-apart from the helical screws, and downstream with respect to the article entry opening, and reorienting at least some of the articles after having passed the article entry opening under guidance of a formed stack part.

18. A method for processing flat articles, the method comprising the steps of:

providing a stack holding unit configured to hold a stack of the articles on-edge, the stack holding unit having an article entry opening for receiving the articles, the article entry opening having a height that is smaller than a height of the articles to be stacked during operation;

providing a helical drive assembly with spaced-apart helical screws disposed separately from the stack holding unit and configured to receive the articles therebetween;

providing a conveyor configured to support lower edges of the articles during transport to the stack holding unit and driving the conveyor at an instantaneous conveying speed;

feeding the flat articles on-edge to the spaced-apart helical screws and thereby turning the articles by way of an article rotation assembly having flat endless belts arranged to convey articles therebetween; and supporting a back side of an article during transfer into the helical drive assembly by way of a downstream belt section of the feeding unit disposed to reach to a position opposite the helical drive assembly.

19. The method according to claim 18, which comprises slowing down the belt section that reaches to the position opposite the helical drive assembly, from a first speed to a second speed, during transfer of an article, for decelerating the article.

20. The method according to claim 18, which comprises transferring the articles on-edge onto an endless conveyor of the holding unit, to form a stack on the endless conveyor.

* * * * *